United States Patent [19]

von Schuckmann

[11] Patent Number: 4,976,380

[45] Date of Patent: Dec. 11, 1990

[54] DEVICE FOR EMPTYING TUBES

[75] Inventor: Alfred von Schuckmann, Kevelaer, Fed. Rep. of Germany

[73] Assignee: Franz Pohl Metall- und Kunststoffwarenfabrik GmbH, Karlsruhe, Fed. Rep. of Germany

[21] Appl. No.: 327,520

[22] Filed: Mar. 21, 1989

[51] Int. Cl.[5] ..... B65D 35/28

[52] U.S. Cl. ..... 222/103; 222/184

[58] Field of Search ..... 222/92, 103, 101, 107, 222/95, 173, 184; 251/4, 9, 10

[56] References Cited

U.S. PATENT DOCUMENTS

| | | | |
|---|---|---|---|
| 2,682,974 | 7/1954 | Smith | 222/107 |
| 2,790,579 | 4/1957 | Woldorf | 222/103 |
| 3,854,628 | 12/1974 | Goings | 222/103 |
| 4,159,787 | 7/1979 | Wright | 222/103 |
| 4,693,399 | 9/1987 | Hickmann et al. | 222/480 |

FOREIGN PATENT DOCUMENTS

| | | | |
|---|---|---|---|
| 585285 | 10/1959 | Canada | 222/103 |
| 582837 | 8/1933 | Fed. Rep. of Germany | 222/103 |
| 1482872 | 6/1967 | France | 222/95 |
| 535394 | 11/1955 | Italy | 222/103 |
| 451933 | 8/1936 | United Kingdom | 222/103 |
| 1291228 | 10/1972 | United Kingdom | 222/95 |

*Primary Examiner*—Michael S. Huppert
*Attorney, Agent, or Firm*—Martin A. Farber

[57] ABSTRACT

A tube squeezer, particularly useful for expelling toothpaste from tubes is provided which has two resilient members protruding upwardly to form a V-shape. The tube is drawn into the V area and flattened to expel material by manual pressure applied to opposite sides of the members. This pressure acts to reduce the volume of the V area, with the corresponding collapse of the tube.

19 Claims, 4 Drawing Sheets

X
α
1
R
St
2
3
4
5
6
7
11
12
12'
13
14
15
15'
15"
22
23

S
St
R
I
X
α

FIG. 18
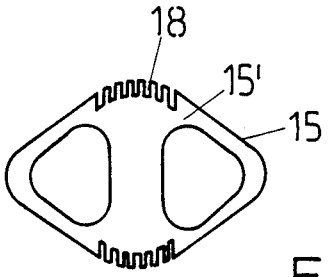
FIG. 19
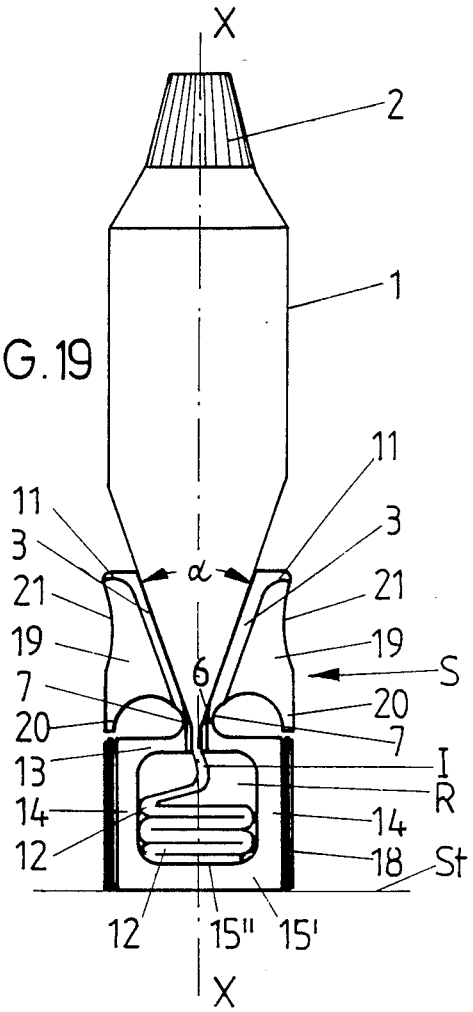
FIG. 16
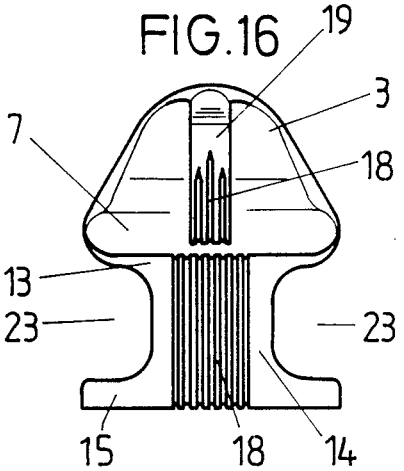
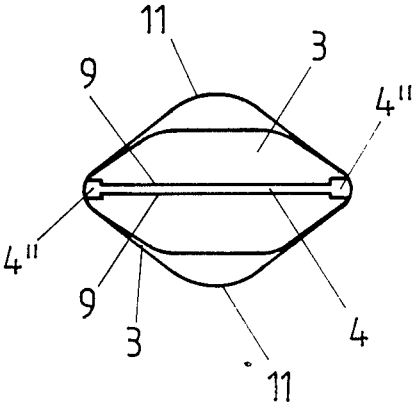
FIG. 17

DEVICE FOR EMPTYING TUBES

FIELD AND BACKGROUND OF THE INVENTION

The present invention relates to a device for the emptying of tubes, in particular toothpaste tubes.

It is known to roll tubes consisting of metal foil up from the bottom so as to keep the remaining quantity nearby, ready for dispensing.

A cream or butter-cream applicator device is known from the bakers/confectioners trade which consists of a non-deformable mouthpiece and an adjoining textile bag of funnel shape. The tip of the bag is connected to the mouthpiece. After introduction of the material to be dispensed, the broadened collar of the bag is gathered and held practically closed by means of a ring which can be pushed down. In this type of closure member, upon the application of pressure to the filled region, the material can emerge, in principle, only at the mouthpiece.

SUMMARY OF THE INVENTION

It is an object of the invention to create a device which is suitable for the emptying of tubes; in particular, the substantially total emptying of laminate tubes is to be possible. Such laminate tubes are known, for example, from U.S. Pat. No. 2,682,974. The layer which forms the outer wall has a restoring tendency. There are at present available on the market also toothpaste tubes having a metallic layer on the inside and a plastic layer on the outside.

According to the invention there is provided a flat mouth slide (8) which widens in V-shape toward the tube mouthpiece (2).

As a result of such development, a device of the type described is obtained which is, in particular, of increased utility: The dispensing is greatly facilitated. The V-shape of the flat-mouth slide, in particular, contributes to this. The mouth structure basically already takes into account the end region of such tubes which is pressed flat at the closed end and is therefore wedge-shaped. The pressed-out tube section can be used in advantageous manner as support. In addition to a pure pushing out one can, of course, also achieve the squeezing out in advantageous manner by deformation of the mouth, without actually having to displace the flat-mouth slide in the direction of the tube mouthpiece for this purpose. This possibility is of particular advantage for a precisely dosaged dispensing. The invention furthermore proposes that the flat-mouth slide have a tube-squeezing slot. The inside width thereof corresponds to twice the thickness of the tube wall, resulting in total dispensing.

It is advantageous in this connection for the slot walls to be connected to each other at their ends via return parts. The length of the tube-squeezing slot corresponds in this connection to at most the flat width of the tube body which practically forms a guide rail for the flat-mouth slide. On the other hand, one can also choose a development in which the tube-squeezing slot has open edges on both sides. In this case the restoring force of the material of the flat-mouth slide could, for instance, be utilized for an application under clamping force. For the changing of the mouth structure, it is advantageous, as a favorable further development advantageous for the V-walls of the flat-mouth slide to form squeezing jaws. The corresponding jaws advisedly have the size of the tip of the thumb or a finger and, in particular, also the length thereof. By placing thumb and index finger on the outside of the squeezing jaws, the flat-mouth slide can easily be actuated.

In order to assure a dependable application despite the relatively small size, the invention further proposes that the squeezing jaws have, in the direction toward the tube mouthpiece, protruding anti-slip projections on their outside. They can be obtained by corresponding shaping or simply by an accumulation of material. To achieve a break-free swingability of such squeezing jaws it has furthermore been found advantageous that on the side of the squeezing slot facing the tube mouthpiece there extend a bending zone of reduced cross-section which extends over the entire width of the squeezing jaws. The bending zone is comparable to a film hinge. The reduction in cross-section, however, remains within such limits that the capacity of the squeezing jaws to restore themselves into their diverging, notch-like basic position is not done away with. The bending zone is, in structurally advantageous manner, developed as a crimp. Such a crimp is preferably located on the outside of the squeezing jaws.

If it is not intended to have the squeezed-out section of the tube protrude freely, then an advantageous further development of the flat-mouth slide of the invention consists in providing on the side of the squeezing slot facing away from the tube mouthpiece a receiving chamber for depositing of the emptied section of tube. Depending on the nature of the tube material used, a rolling up can take place here or else a zig-zag folding. A suitable receiving chamber can be obtained by simple means having a cover wall with an opening for the squeezing slot, two side walls adjoining the cover wall on both sides and a bottom wall.

If the deposit is to be kept out of sight, it is of course not difficult also to close off the two remaining sides of such a basically box-shaped receiving chamber, for instance, by clip-attachment of at least one wall since the other wall can be formed thereon from the very start. A solution which suggests itself as an advantageous variant is that the receiving chamber have a cover wall which extends on one side from the squeezing slot, an adjoining side wall and a bottom wall. In this way, there results a practically C-shaped receiving chamber with free view into the deposit chamber.

In order to avoid a wrong course of the flattened tube body, the invention further proposes to provide a deposit-limiting stop on the bottom wall, on the side opposite the side wall. It also proves to be advantageous in this connection for the deposit-limiting stop to have a hook projection at its head which points into a storage-limiting space. The depositing function is in this way optimized. It is favorable, in particular, for an orderly zig-zag depositing for the bottom wall to extend at an angle to the longitudinal central axis and parallel to the slot walls. The flattened entering section is in this way dependably folded over, in which connection concave roundings at the wall transitions are of course also helpful.

In the case of flat-mouth slides the squeezing slot of which is not closed at the end, it may in any event be advantageous for the stabilizing of the squeezing jaws and the basic body to provide, on the outside of said squeezing jaws, support arms which are located facing the top of the cover wall of the receiving chamber. During transverse insertion of the flattened end of a tube into such a flat mouth slide, the squeezing jaws do not break off when they are swung outward to assist in the spreading. The structural measure of the squeezing slot being widened at both ends takes into account the slightly protruding, bead action of the fold hollows of the tube.

Another advantageous development consists furthermore of a rhombic basic cross-sectional shape of the flat-mouth slide, it having preferably the dimensions of an ordinary packaging box. The flat-mouth slide can therefore already be placed on by the manufacturer. The longer axis of the rhombus extends in this case along the diagonal of the receiving space of the package. No other part of the device extends beyond the rhombic basic cross-sectional shape, i.e. cover wall and bottom wall have a rhombic shape although they extend in a different direction.

The bottom wall forms a resting surface in order to be able to place the tube upright on a table in the same manner as known dispensing devices. Otherwise the customary handling of the tube is fully retained in view of the smallness of the device and its light weight. In order, finally, to prevent the flat-mouth slide, after it has been applied, from moving away or sliding off due to the wedge-shape of the tube end, an anti-backslide device formed of barb-like projections is provided in the region of the squeezing slot. The corresponding toothing can easily be realized via the slot structure, for instance by slot edges which converge toward the mouthpiece and have a steep flank on the bottom side which extends perpendicular to the direction of displacement of the tube.

BRIEF DESCRIPTION OF THE DRAWINGS

With the above and other objects and advantages in view, the present invention will become more clearly understood in connection with the detailed description of a preferred embodiments, when considered with the accompanying drawings, of which:

FIG. 16 shows the flat-mouth slide in accordance with the fourth embodiment, again in front view, FIG. 17 is a top view thereof, FIG. 18 is a bottom view, and FIG. 19 shows the flat-mouth slide associated with a toothpaste tube.

DETAILED DESCRIPTION OF THE PREFERRED EMBODIMENTS

Figure 3:
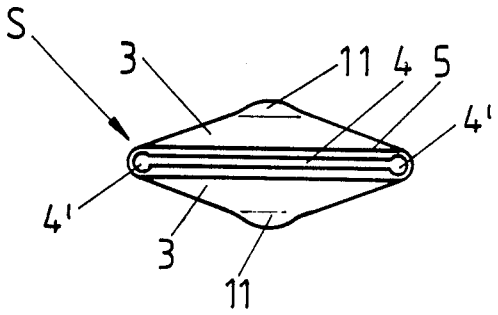
FIG. 3 is a bottom view.
Figure 1:
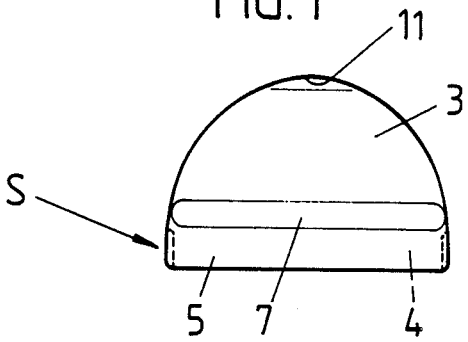
FIG. 1 is a front view of the flat-mouth slide in accordance with the first embodiment.
Figure 2:
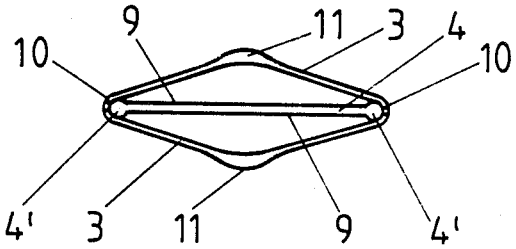
FIG. 2 is a top view thereof.
Figure 4:
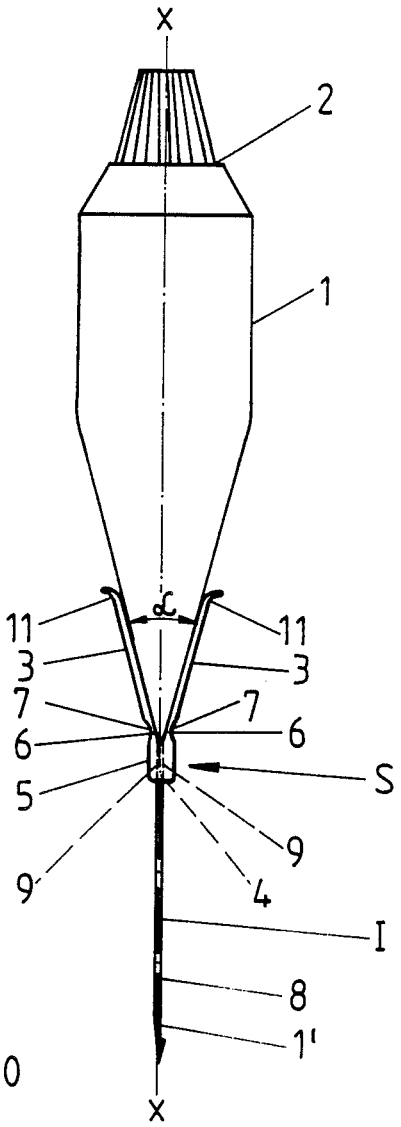
FIG. 4 is a side view of the flat-mouth dispenser associated with a toothpaste tube, the tube being partially emptied.

The flat-mouth slide S which serves to empty a tube, in particular a toothpaste tube 1, is placed on the flattened closed end 1' of the tube.

This end which is closed by folding and/or sealing passes in wedge-shape into the shape of the tube, which is basically of circular cross-section. Corresponding to this wedge-shape, the flat-mouth slide S of all embodiments is widened towards the tube mouthpiece 2 in the manner of a V or of a notch valley; the opening angle alpha of the mouth amounts to about 30° .

The V-walls of the flat-mouth slide S are formed by squeezing jaws 3. These are tabs or wings of the size of the phalanx or tip of the thumb and of arcuate contour, corresponding approximately to a semi-circle.

The squeezing jaws 3 are attached to the base part 5 of the slide S, which base part forms a transverse slot 4 in the apex region of the notch valley. In order to create a well-defined hinge zone for the squeezing jaws, a bending zone 6 of reduced cross-section extends over the entire width of the squeezing jaw on the side of the straight squeezing slot 4 facing the tube mouthpiece, the bending zone being obtained by a crimp 7 arranged on the outside of the jaws.

The width of the squeezing slot 4 corresponds to twice the wall thickness of the toothpaste tube 1. The length of the squeezing slot 4 takes into account the width of the flattened tube section I which then serves as guide rail. In order to provide space for the slightly bead-like edge 8 of the section I, the squeezing slot 4, is widened on both ends. In the case of a closed squeezing slot 4 the corresponding widening is produced by a circular cylindrical cutout 4' which extends slightly beyond the width of the slot. In the case of a continuous open squeezing slot, corresponding step-shaped undercuts 4'' (see FIG. 17) are sufficient. With a closed squeezing slot 4, the longer sections of the slot walls 9 which extend parallel to each other are connected to each other at their ends via return parts 10. In the version with open edges, these slot walls 9 terminate practically free-standing and therefore with open edge.

In all embodiments, the squeezing jaws 3 form, in the direction toward the tube mouthpiece 2, protruding anti-slip projections 11 on their outside. The projections are created either by an outward-directed, segment-shaped bending or, as can be noted, for example, from FIG. 8, as the result of an accumulation of material, so that an outward-directed small tongue is produced which forms a fillet which corresponds to the rounding. The anti-slip projections 11 lie at the zenith of the arcuate curvature of the edges of the squeezing jaws 3 on the side towards the tube mouthpiece.

With the exception of the object in accordance with the first embodiment, all flat-mouth slides S form, on the side of the squeezing slot 4 facing away from the tube mouthpiece, a receiving chamber R for depositing of the emptied tube section I. Said section I is deposited in the receiving chamber R in practically zig-zag-shaped layers 12 with alternating turns 12.

The receiving chamber R is formed by a cover wall 13 located on the side towards the mouthpiece and having an opening for the squeezing slot 4, two side walls 14 adjoining the cover wall on both sides, and a bottom wall 15. In the embodiments according to FIGS. 8 and 14, the cover wall descends slightly in the manner of an inclined roof; in the embodiment according to FIG. 16, however, it has a substantially horizontal course. Therefore, in that case it extends precisely perpendicular to the direction of displacement of the tube 1. The side walls 14, on the other hand, extend in said direction of displacement. In the embodiment according to FIG. 8, they extend parallel to each other. There is thus present here a stirrup-like construction.

The width of the side walls 14 is reduced; they are decreased to about one-third the width of the base part 5. The depositing can in this way be observed well also optically. On the other hand, there results a saving of material which today is definitely of interest again.

Figures 11, 12, 13, 14, 15:
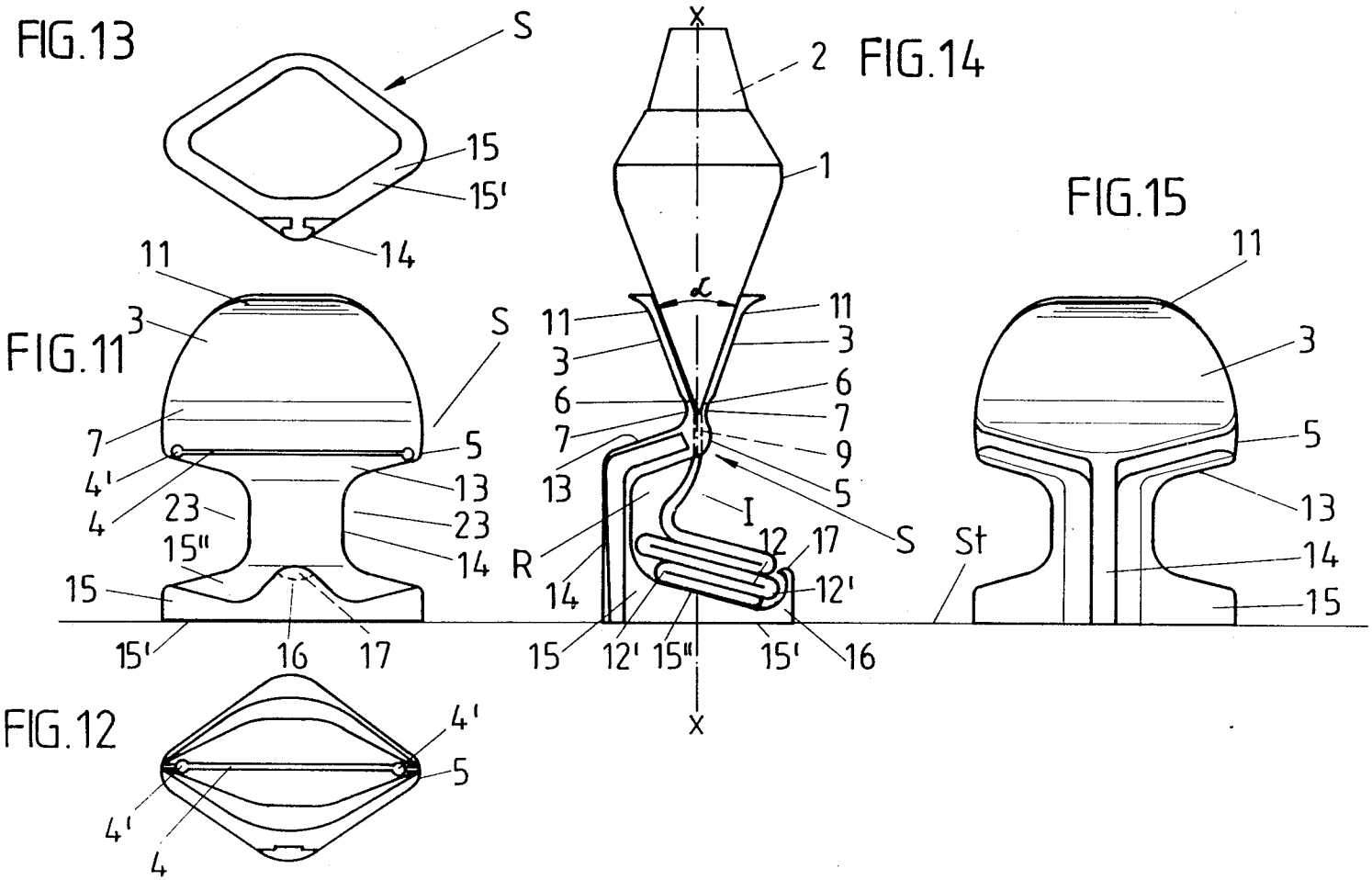
FIG. 11 is a front view of the flat-mouth side in accordance with the third embodiment.
FIG. 12 is a top view thereof.
FIG. 13 is a bottom view.
FIG. 14 is a side view of the flat-mouth slide associated with a toothpaste tube, the latter being partially emptied.
FIG. 15 is the rear view of the flat-mouth slide.

In the embodiment of FIG. 14, the receiving chamber R has a cover wall 13 extending on one side from the squeezing slot 4 and passing via the side wall 14 there into the bottom wall 15. This leads to a kind of C-shaped profile.

In all embodiments, the bottom wall 15 forms on its bottom side a standing surface 15' which makes it possible to place the tube 1, which has been provided with the flat-mouth slide S, on a bracket or resting surface St in the upright position customary with so-called dispensers.

In the case of the solution according to FIG. 14 in which the receiving chamber is open toward one side wall, in the interest of a nevertheless orderly folding deposit, a storage-limiting stop 16 is provided on the bottom wall 15 on the side lying opposite the side wall 14. The limiting stop extends from the bottom wall 15 and passes, on the side facing the mouthpiece, into a transversely directed hook projection 17 (FIG. 14) which points into the deposit receiving chamber R. The hook projection has an inside height which corresponds to the expected height of the layers 12.

The bottom deposit surface 15'' formed by the top side of the bottom wall 15 extends at an angle to the longitudinal central axis x-x of the tube 1 or of the flat-mouth slide S, namely parallel to the slot walls 9. The transitions to the side wall or walls 14 are concavely rounded. The same is true with respect to the storage-limiting stop 16. The angle of inclination of the storage surface 15'' is about 15° with respect to the standing surface 15' of the bottom wall 15.

In the embodiment of FIG. 19, the top side of the bottom restoring force of the material. The squeezing slot, which is open on both ends, is under permanent application pressure of its slot walls 9 against the developing wide surface of the tube section I. In this way, there results a particularly adaptable squeezing out of the content in case of different tube-wall thicknesses. In order to optimize this entire spring-jaw function, the side walls 14 are particularly stable there for standing and therefore thicker. So as nevertheless to save material, the outer sides of the two parallel side walls 14 have a rib structure 18 extending in longitudinal direction. Furthermore the somewhat thicker squeezing jaws 3 have support arms 19 on their outer side. These are vertically directed ledges formed thereon which, lying in the plane of symmetry are also vertically ribbed in the back, terminate in a downward directed nose 20 in front of the cover wall 13 which is horizontal there.

In order not to impair the swingability of the jaws, the support arms 19 are rooted only adjoining the crimp 7 there in the outer surface of the squeezing jaws. Excessive wedge action in the funnel region thus does not lead to a breaking off of the squeezing jaws. On the other hand, the actuating of the squeezing jaws in the direction of a reduction in the angle alpha is readily possible also in this case. For the insertion of the finger of the operator, the back of the support surface 19 which is advisedly transversely rounded on the outside has a finger-insertion trough 21.

Figures 5, 6, 7, 8, 9, 10:
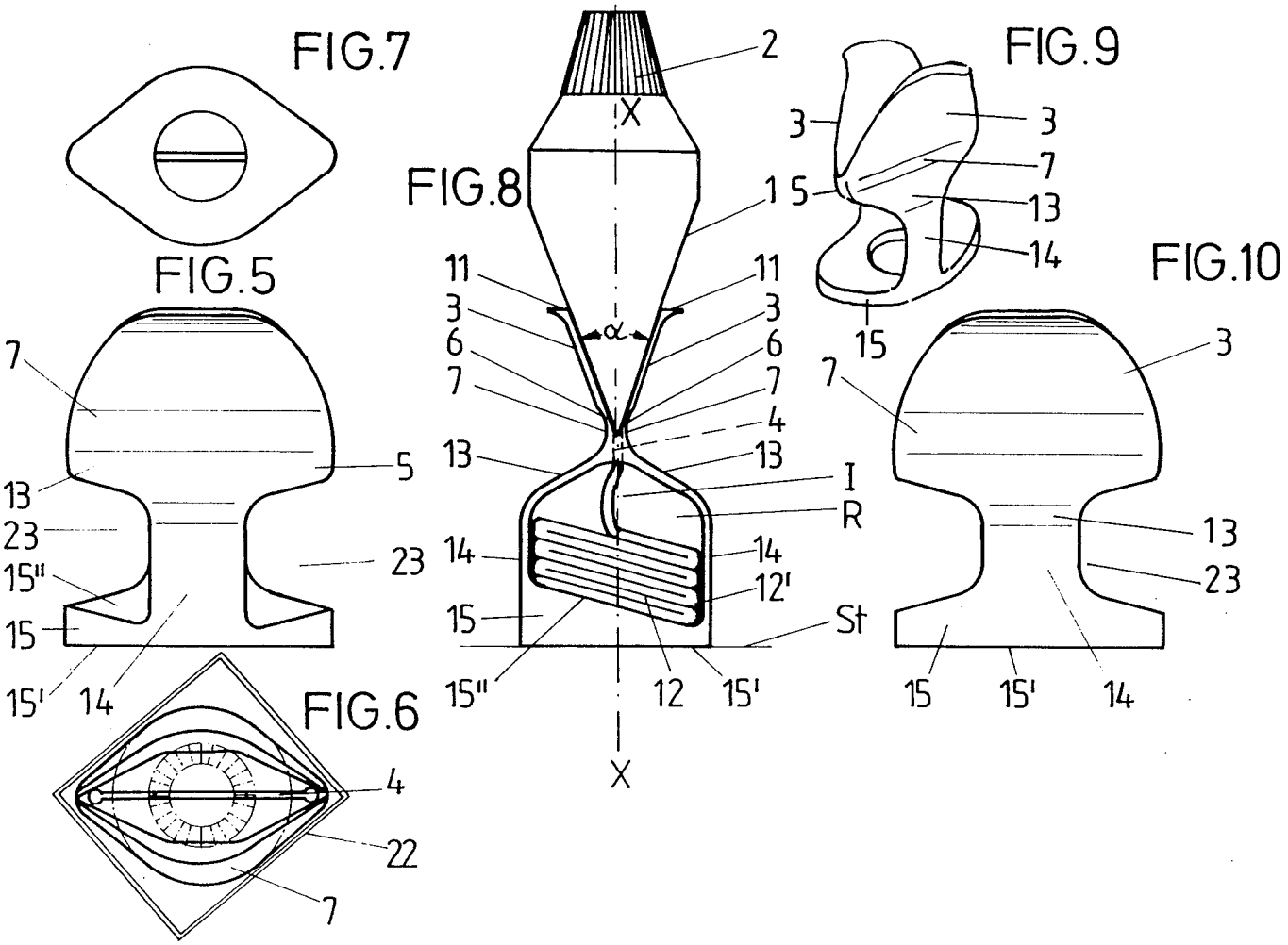
FIG. 5 is a front view of the flat-mouth slide in accordance with the second embodiment.
FIG. 6 is a top view thereof, with the package cross-section indicated.
FIG. 7 is a bottom view.
FIG. 8 is a side view of the flat-mouth dispenser associated with a toothpaste tube, the latter being partially emptied.
FIG. 9 is a perspective view of the flat-mouth slide.
FIG. 10 is a rear view of the flat-mouth slide.

The basic cross-sectional shape of all the flat-mouth slides S is rhombic. In the first embodiment, the squeezing jaws 3 are the pertinent shaping elements. In this case a relatively flat rhombic shape is present. A basic shape closer to a square or a short rectangle results from the other embodiments. The determining factor there is, in particular, the bottom wall 15 which defines the resting surface 15''. The corners are rounded or a capped flat. In the case of the embodiment of FIG. 8 there is shown in FIG. 6 a package cross-section 22. There are concerned in this case the customary commercial packages with corresponding dimensions, so that the tube 1 can be equipped already by the manufacturer with the auxiliary device in the form of the flat-mouth slide S. The long axis of the rhombus extends along one diagonal of the package.

In order to assure in this connection the dependable retention of the flat-mouth slide and, in particular, also in order to prevent a creeping back of the flat-mouth slide from its end position at the time, the slide has an anti-slideback device which is formed in the region of the squeezing slot 4 by barb-like projections. The anti-slideback device is formed by a slight divergence of the slot walls 9 (not shown) on the side facing the mouthpiece and, adjoining below same, a steep flank of the slot edges on the cover side, as can be noted from the drawings. Such projections can also be present on the inside of the return parts and cooperate with the bead 8. The pushing-through in the direction of the receiving chamber R takes place with easy motion; movement in the opposite direction, however, is blocked by the unilaterally acting blocking device.

Additional measures with a view toward a saving of material can be realized by recesses, as can be noted from FIGS. 9, 15 and 18, namely as follows: A central opening in the wedge-shaped bottom wall 15 or formation of a cavity in this bottom wall from the bottom side (FIG. 18) or ribbing of the region of the side wall and cover wall (FIG. 15).

The narrowed side walls 14 leave, between the protruding parts of the cover wall 13 and the bottom wall, grip recesses 23 for the holder of a mounting device (not shown in detail) for the flat-mouth slide.

I claim:

1. A device for emptying a tube, including the emptying of a toothpaste tube, the tube having an outlet port in the form of a mouthpiece through which contents of the tube are emptied, the device comprising a flat mouth slide which widens in V-shape toward the tube mouthpiece, the flat mouth slide having a tube squeezing slot, the flat mouth slide having V-walls oriented at an acute angle to each other in the form of a V, the tube squeezing slot cooperating with the flat mouth slide to form expulsion jaws which are flexible for displacement against a restoring force;

a receiving chamber lying on a side of the squeezing slot facing away from the tube mouthpiece for receiving an emptied tube section;

a bottom wall closing off the receiving chamber; and the bottom wall forms a standing surface for supporting the tube.

2. A device according to claim 1, further comprising slot side walls and slot end walls, the slot side walls being connected to each other at their ends by the slot end walls.

3. A device according to claim 2, wherein said slot end walls are parallel to a central axis of the device.

4. A device according to claim 2, wherein said slot side walls and said slot end walls are parallel to a central axis of the device.

5. A device according to claim 1, wherein the expulsion jaws have anti-slip projections protruding on their outside, towards the tube mouthpiece.

6. A device according to claim 1, wherein the receiving chamber comprises a cover wall with an opening for the squeezing slot; and two side walls adjoining the cover wall; and the bottom wall is connected to the side walls.

7. A device according to claim 6, wherein the bottom wall has an upper surface which extends at an angle to a longitudinal axis of the tube and parallel to the walls of the slot.

8. A device according to claim 6, wherein the cover wall and the bottom wall are of rhombic shape.

9. A device according to claim 1, wherein the receiving chamber comprises a cover wall extending on one side from the squeezing slot; and a side wall adjoining the cover wall; and the bottom wall is connected to the side wall.

10. A device according to claim 9, further comprising a deposit limiting stop located on the bottom wall on the side opposite the side wall.

11. A device according to claim 9, further comprising support surfaces disposed on the outside of the squeezing jaws, the support surfaces lying opposite the top side of the cover wall of the receiving chamber.

12. A device according to claim 9, wherein said slide has the basic shape of a rhombus in cross-section.

13. A device according to claim 1, wherein the squeezing slot widens at both ends.

14. A device according to claim 1, further comprising an anti-backslide element formed of barb-like projections in the region of the squeezing slot.

15. A device for emptying a tube, including the emptying of a toothpaste tube, the tube having an outlet port in the form of a mouthpiece through which contents of the tube are emptied, the device comprising a flat mouth slide which widens in V-shape toward the tube mouthpiece, and the flat mouth slide having walls extending in the form of a V from a central portion of the slide to form expulsion jaws; and wherein the flat mouth slide has a tube squeezing slot formed in said central portion between said jaws;

on the side of the squeezing slot which faces the mouthpiece of the tube, there extends a bending zone of reduced cross-section which extends over the entire width of the expulsion jaws; and the device further comprises:

a receiving chamber lying on a side of the squeezing slot facing away form the tube mouthpiece for receiving an emptied tube section; and means for forming a part of the chamber for holding the tube in an upright position.

16. A device according to claim 15, wherein the reduction in cross-section is obtained by a crimp.

17. A device for emptying a tube, including the emptying of a toothpaste tube, the tube having an outlet port in the form of a mouthpiece through which contents of the tube are emptied, the device comprising a flat mouth slide which widens in V-shape toward the tube mouthpiece; and the flat-mouth slide has a tube-squeezing slot;

on the side of the squeezing slot facing away from the mouthpiece of the tube there is a receiving chamber for a depositing of the emptied tube section;

the receiving chamber comprising a cover wall extending on one side from the squeezing slot;

a side wall adjoining the cover wall; and a bottom wall connected to the side wall;

the device comprising a deposit limiting stop located on the bottom wall on the side opposite the side wall; and the deposit limiting stop has a head formed as a hook projection which points into the deposit limiting space.

18. A device for emptying a tube, including a toothpaste tube, the tube having a mouthpiece through which contents of the tube are emptied, the device comprising a flat mouth slide which widens in V-shape toward the tube mouthpiece; and wherein the flat mouth slide has a tube-squeezing slot;

the device further comprising slot side walls and slot end walls, the slot side walls being connected to each other at their ends by the slot end walls;

the tube-squeezing slot is developed with open edges on both sides;

the tube-squeezing slot widens at both ends; and the device further comprises:

a receiving chamber lying on a side of the squeezing slot facing away from the tube mouthpiece for receiving an emptied tube section; and means forming a part of the chamber for holding the tube in an upright position.

19. A device according to claim 18, wherein said slot end walls are parallel to a central axis of the device.

* * * * *